US006034644A

United States Patent [19]

Okabe et al.

[11] Patent Number: 6,034,644

[45] Date of Patent: Mar. 7, 2000

[54] TUNABLE SLOT ANTENNA WITH CAPACITIVELY COUPLED SLOT ISLAND CONDUCTOR FOR PRECISE IMPEDANCE ADJUSTMENT

[75] Inventors: Hiroshi Okabe, Kokubunji; Ken Takei, Hachioji, both of Japan

[73] Assignee: Hitachi, Ltd., Tokyo, Japan

[21] Appl. No.: 09/086,585

[22] Filed: May 29, 1998

[30] Foreign Application Priority Data

May 30, 1997 [JP] Japan ..... 9-141375

[51] Int. Cl.[7] ..... H01Q 13/10

[52] U.S. Cl. ..... 343/767; 343/746; 343/750

[58] Field of Search ..... 343/767, 745, 343/746, 749, 750, 829, 830, 700 MS, 702, 769

[56] References Cited

U.S. PATENT DOCUMENTS 4,733,245 3/1988 Mussler ..... 343/769

5,465,100 11/1995 Remondiere et al. ..... 343/769

FOREIGN PATENT DOCUMENTS 63-294107 11/1988 Japan ..... H01Q 13/08

9-083232 3/1997 Japan ..... H01Q 1/38

9-260935 10/1997 Japan ..... H01Q 13/10

OTHER PUBLICATIONS

U.S. application No. 08/708,563, Takei et al., filed Sep. 5, 1996.

U.S. application No. 09/035,848, Takei, filed Mar. 6, 1998.

*Primary Examiner*—Don Wong

*Assistant Examiner*—Hoang Nguyen

*Attorney, Agent, or Firm*—Beall Law Offices

[57] ABSTRACT

A coaxial resonant slot antenna includes a flat rectangular conductive box having its top plate with a slot being defined therein, and a strip conductor disposed inside the box and electrically insulated from the box while high frequency or RF power is fed to the strip. An island conductor is provided in the slot for defining a capacitance between itself and the frame. This capacitance is rendered variable in value by use of a variable circuit.

15 Claims, 10 Drawing Sheets

TUNABLE SLOT ANTENNA WITH CAPACITIVELY COUPLED SLOT ISLAND CONDUCTOR FOR PRECISE IMPEDANCE ADJUSTMENT

BACKGROUND OF THE INVENTION

The present invention relates generally to antenna architectures and, more particularly, to slot antenna structures utilizing a coaxial resonator for use with mobile communication units including, but not limited to, cellular radiotelephone handsets in wireless communications systems.

Wireless telecommunication systems are known to employ portable or handheld mobile communication units such as for example cellular radiotelephone handsets operatively associated with a limited number of wireless communication resources and a remote system resource controller. As the cellular handsets require smaller size and less thickness, miniaturization or "down-sizing" of the antenna module adapted for use with such units has become more critical in recent years. Until today, several approaches to the small-size antenna have been proposed and developed. One previously known approach is to use a slot antenna incorporating a coaxial resonator. An exemplary coaxial-resonator slot antenna has been disclosed in U.S. Pat. No. 5,914,693 filed Sep. 5, 1996. The slot antenna disclosed is structurally designed so that its centrally disposed elongate or "strip" conductor is kept in non-contact with a flat rectangular box-like conductive frame body of the resonator to miniaturize the antenna. This antenna also features in absence of any particular outer projections facilitating mounting of the antenna into the enclosure of a cellular radiotelephone handset.

Since the prior art small-size slot antenna has such resonator structure, the volume thereof is proportional to its impedance matching bandwidth—that is, the smaller the volume, the less the bandwidth. Accordingly, in cases where the antenna is practiced at communication units of a broadband wireless communication system with an increased capacity by use of a plurality of different carrier frequencies allocated thereto, the impedance matching frequency band to be achieved by the antenna might be widened enlarging the antenna in size and in volume.

As readily appreciated by a person skilled in the art, those frequencies used for telephone interconnect calls between one particular base station and its associated wireless communication units, such as cellular handsets, are much less than the frequency band inherently allocated to the entire communication system. Accordingly, adaptively changing the antenna's impedance matching center frequency to a presently selected frequency for a telephone call attempt may render narrower the antenna's inherent frequency band, which in turn downsizes the antenna. One typical antenna module incorporating this approach is a tunable slot antenna as disclosed in copending U.S. patent application (Ser. No. 09/035,848, filed Mar. 6, 1998. This antenna is a coaxial resonator-used slot antenna including a variable capacitive element connected between a selected location at or near one end of a built-in strip conductor, which end is far from a connection point of the strip being supplied with high-frequency electric power, and an opposing plate of a rectangular box. The antenna may vary in impedance matching center frequency by varying the capacitance value of the variable capacitance element. An exemplary structure of the tunable slot antenna is shown in FIGS. 10*a* and 10*b*.

The tunable slot antenna shown in FIGS. 10*a*–10*b* includes a conductive flat box 1. The box 1 has therein an elongate strip-like conductor 3 that is electrically insulated from the box 1 and extends along the axis of resonance. The box 1 has a top plate surface in which a slot 2 is formed overlying and crossing the strip 3. Strip 3 has one end at which a connection point 10 is disposed and its opposite end has a small opening 11 defined for disposal of an island conductor 4. The connection point 10 is operatively coupled to a high frequency or radio frequency (RF) power supply circuit 7, which operates to supply RF power between the connection point 10 and its opposing part of the bottom plate of the box 1. RF power supply 7 is associated with a certain element for elimination of unwanted high frequency current drain, and a variable direct current (DC) power supply 9. A variable capacitive element 6 is connected between a selected location at or near the far end of strip 3 with small hole 11 and its opposing part of the top plate of the box 1. Variable capacitor 6 receives a DC voltage from DC power supply 9 via strip 3 and RF current drain eliminator 8.

In the antenna structure of FIGS. 10*a*–10*b*, the variable capacitor 6 may vary in capacitance value in response to receipt of a DC voltage applied from variable DC power supply 9 thereby causing a current flowing in strip 3 just beneath slot 2 to likewise change in phase. Such strip current phase change may in turn serve to permit strip 3 to change in length equivalently or "virtually," which length closely relates to the resonant frequency of the tunable slot antenna shown. This makes it possible for the antenna to change or modify the impedance matching center frequency, that is, resonant frequency.

BRIEF SUMMARY OF THE INVENTION

The coaxial resonator-based slot antenna taught by U.S. patent application Ser. No. 08/708,563 and the tunable slot antenna proposed in the prior U.S. patent application based on Japanese Patent Application No. 9-54825 are such that the matching condition is determinable depending on both the strip current phase and the slot length. In this respect, suppose in the FIG. 10 antenna that the capacitor 6 is varied in capacitance altering the current phase of strip 3. If this is the case, as the resonant frequency varies, so does the resultant matching condition, thereby rendering it difficult to efficiently supply the antenna with RF power. The prior art approaches are also faced with a problem: the inability to permit the resonance frequency to vary over a wide range while achieving such efficient RF power supply to the antenna. This can be said because the variable capacitor for suppressing the variation range of the matching state to the extent that RF power is efficiently supplied to the antenna remains extremely less in both absolute capacitance value and changeable quantity.

It is therefore an object of the present invention to provide a new and improved slot antenna structure capable of avoiding the problems encountered with the prior art.

It is another object of the invention to provide an improved tunable slot antenna capable of permitting the resonant frequency to vary over an extended range while maintaining the antenna matching condition required.

It is a further object of the invention to provide a tunable slot antenna capable of forcing both the length of a slot and the length of a strip-like conductor immediately underlying the slot to equivalently vary or change at a time, thereby widening the resonant frequency variable range while maintaining the antenna matching condition required.

According to one aspect of the present invention, a tunable slot antenna includes a conductive box with a slot formed in one principal surface thereof, and a conductor insulatively disposed or "embedded" inside the box to spatially intersect the slot. Alternating current (AC) power is fed between a connection point of the conductor and the box. The box also includes an island-like conductor which is formed in the slot to be electrically isolated from the box, and electrical circuitry connected between the island and a wall plate of the box for permitting the capacitance therebetween to vary in value.

In accordance with another aspect of the invention, a tunable slot antenna is provided which includes a flat conductive box of a generally parallelepipedic shape or rectangular prism shape, and an elongate conductor or "strip" member insulatively embedded inside the box. The box has in its upper plate surface a slot overlying the conductive strip to spatially cross the same. The strip has one end where a connection point is disposed and connected thereto, permitting high frequency or radio frequency (RF) power to be supplied between the connection point and a wall plate of the box. The box also includes an elongate island conductor as disposed within the slot. The island conductor is electrically insulated from the box. Variable capacitance circuitry is provided and connected between the island conductor and the wall plate of the box for allowing the capacitance therebetween to vary in value. With such an arrangement, varying the capacitance between the island conductor and the wall plate of the box may cause the antenna to widely vary or change in impedance matching center frequency, i.e. resonant frequency, without affecting the inherent matching condition of the tunable slot antenna.

It should be noted that scheme for letting the resonant frequency of coaxial resonator-based slot antenna to vary by equivalently or "virtually" altering the physical length of the strip conductor has also been employed in the structure shown in FIGS. 10*a*–10*b*. One significant difference of the invention over this structure is that the latter is designed to directly couple its variable capacitive element between the end of such strip and a wall plate of the box whereas the former incorporates a specific variable capacitance circuit capable of varying the value of a capacitance between the island conductor and a wall plate of the box, the island conductor being disposed within the slot and capacitively coupled to the strip. Thereby, even where the capacitance value is greatly altered by the variable capacitance circuit, it is possible to insure fine or precise capacitance value variation between the strip and the box, which may in turn enable the antenna to change its impedance matching center frequency with increased accuracy and enhanced reliability.

It is also noted that a minimal configuration required to attain the intended virtual slot length variability or adjustability stated supra may be a slot antenna having a first conductor with a slot formed therein, and a second conductor while AC power is supplied between the first and second conductors, wherein the antenna further includes a third conductor disposed inside the slot to be electrically insulated from the first conductor, and circuitry connected between the first and third conductors for permitting a capacitance therebetween to vary in value.

Additionally, the prescribed island conductor capacitively coupled to the strip need not always be provided in the slot in order to achieve the objective of precisely changing the antenna impedance matching center frequency by creation of a minute or fine capacitance value variation between the "internal" conductor embedded inside the box and a wall plate of the box. In some cases a slot antenna is employable which includes a conductive rectangular box with a slot formed in its one principal surface, and a conductor insulatively disposed inside the box and spatially crossing the slot while letting AC power supply be fed between a connecting point of the conductor and the box, wherein the antenna further includes an island conductor capacitively coupled to the conductor inside the box, and circuitry connected between the island and the box for varying or changing the value of a capacitance between the two.

The invention should not exclusively be limited to the slot antennas, and may alternatively be applicable to those antenna modules of the type which may include a first conductor and a second conductor with AC power being supplied therebetween, wherein a third conductor is disposed opposing the second conductor while circuitry is connected between the first and third conductor for varying the capacitance in value therebetween. In this case also, it is possible to attain a fine or precise capacitance value variation between the first and second conductors.

The tunable slot antenna's matching condition is determinable by both the current phase on the conductive strip underlying the slot and the length of such slot. Where the variable capacitance circuit operates to change or vary the capacitance value between the island conductor and a grounded wall plate of the box, if for example the resulting capacitance is sufficiently large in value, the island conductor is substantially equal in potential to the wall plate—namely, ground potential. This causes the slot to equivalently or "virtually" decrease in width to the extent that such reduction corresponds to the size of island conductor. This partial decrease in slot width may be equivalent to an increase in slot length. Thus, varying the capacitance value of the variable capacitance circuit enables the slot to virtually vary in length. Since an increase in capacitance value results in an virtual increase in both strip length and slot length, it becomes possible to maintain the intended matching condition of the antenna.

The variable capacitance circuit for use with the tunable slot antenna incorporating the principles of the invention may be a device or element variable in capacitance value upon application of a DC voltage thereto, including but not limited to a capacitance variable diode. When employing such DC voltage-controlled capacitance-variable element, one end of it is electrically connected to the island conductor whereas the other end thereof is coupled to a grounded wall plate of a flat conductive box. This makes it possible to permit the capacitance between the island conductor and the wall plate of the box to vary upon application of a DC voltage to the island conductor.

Supplying a control signal to the variable capacitance circuit is attainable by providing a control signal transmission lead wire as embedded inside the box and is electrically insulated from the box, which lead has one end connected to the circuit via a small hole formed in a selected plate of the box and an opposite end coupled to a control circuit through another small hole in a box plate.

The use of such antenna for communication units in wireless communications systems makes it possible to properly tune the antenna's resonant frequency at any selected one of radio frequencies updatable every time a connection is done for telephone interconnect calls. In this case, the frequency band allocated to the antenna per se may be narrowed to cover a mere bandwidth required for such telephone calls. This renders the resulting antenna frequency band considerably narrower than the frequency band allocated to the wireless communications system. Consequently, the antenna module may be less in volume than prior art antennas designed to cover the whole part of the system frequency band, which may in turn facilitate mounting the antenna to wireless communication units such as for example handheld radiotelephone handsets. Further, since the antenna offers widened or extended resonant-frequency variable range, the applicability thereof may likewise expand covering those radiotelephone handset units for use in broad-band wireless communications systems.

Furthermore, the prescribed variable capacitance circuit for use with the tunable slot antenna in accordance with the invention may be certain circuitry responsive to receipt of a control signal applied at a certain terminal thereof for performing a switching operation to selectively change between two or more preset capacitance values. Typically, the circuitry may be a combination of a high frequency or RF switch device and more than one capacitive elements operatively coupled thereto. In this case the RF switch has its control node, and also input and output nodes one of which is connected to the frame plate and the other of which is coupled to an island conductor via a capacitive element. With such an arrangement, the capacitance between the island conductor and the wall plate of the box may be varied or modified in value by supplying a control signal to the control node of RF switch thereby attaining the intended turn-on/off control thus causing the switch to be in either the open state or close state between its input and output nodes.

The use of a plurality of such capacitive elements and a multi-input/output RF switch may achieve multi-value capacitance variation scheme. Where appropriate, the plural capacitors and multi-node RF switch may be implemented into a single integrated circuit (IC) chip set.

These and other objects, features and advantages of the invention will be apparent from the following more particular description of preferred embodiments of the invention, as illustrated in the accompanying drawings.

DETAILED DESCRIPTION OF THE INVENTION

Figure 1A:
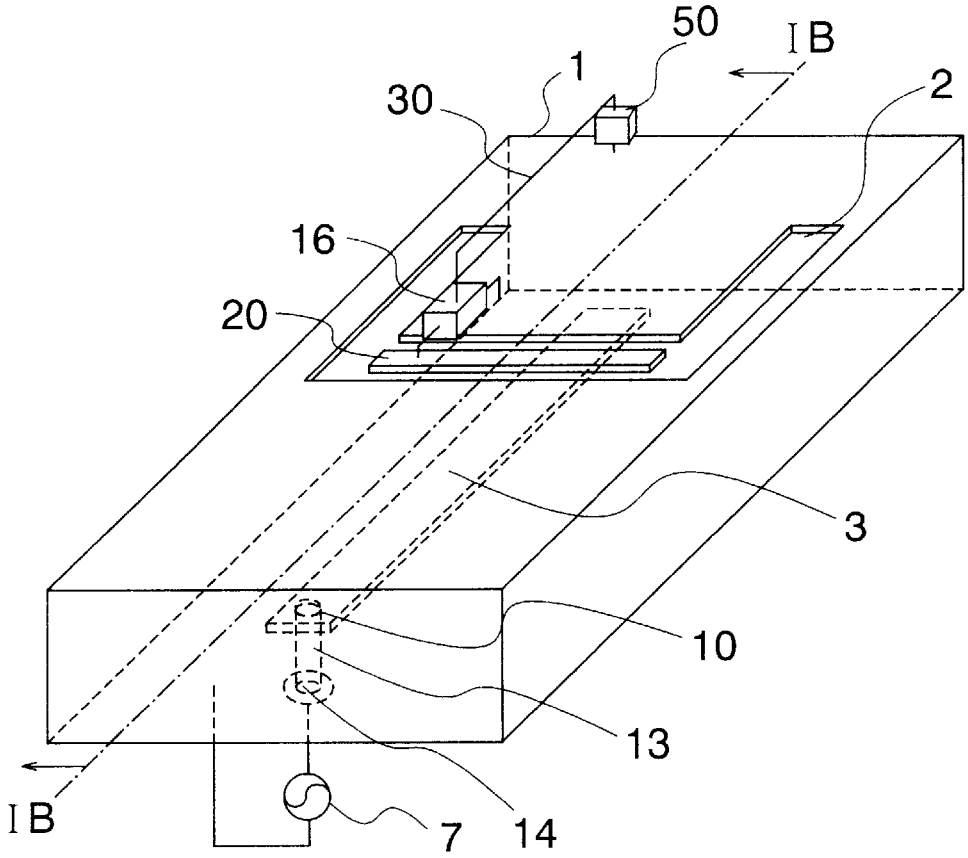
FIG. 1*a* is a perspective view of a tunable slot antenna according to a first embodiment of the present invention.

Tunable slot antenna in accordance with some preferred embodiments of the present invention will be described in detail with reference to FIGS. 1*a* to 9*b* below. Note that the same reference numerals are used to designate the same or similar parts or components.

First Embodiment

Figure 1B:
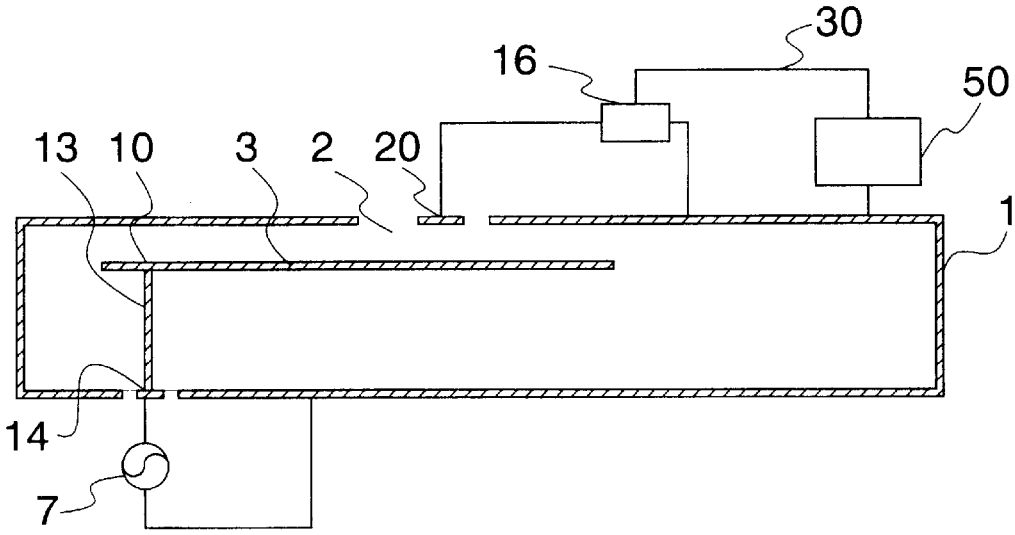
FIG. 1*b* is a sectional view taken along line IB—IB in FIG. 1*a*.

A tunable slot antenna in accordance with one embodiment of the invention is shown in FIGS. 1*a* and 1*b*, wherein FIG. 1*a* is a perspective view whereas FIG. 1*b* is a sectional view taken along line IB—IB of FIG. 1*a* (not drawn to scale). The slot antenna shown is arranged to include a flat conductive box 1 of a rectangular or parallelepipedic shape. The conductive box 1 has a top wall plate, a bottom wall plate, two opposite end wall plates and two opposite side wall plates, all of the wall plates being electrically conductive, as shown in FIG. 1*a*. The box 1 has in its top plate a generally "U"-shaped slot opening 2. The shape of the slot opening 2 is not limited to the illustrated one. The interior space of the box 1 is filled with a dielectric material (not shown), in which an elongate strip-like conductor 3 is securely embedded. The strip 3 has at its one end a connection point or a coupler section 10, and has its opposite end acting as a free or open end, which immediately underlies and spatially intersect the U-shaped slot 2. The box 1 is coupled to ground potential.

The box 1 has in the bottom plate an island conductor 14 in its corresponding hole formed at a location near one of the end wall plates of the box 1. The island conductor 14 is electrically insulated from the box 1. The island conductor 14 is positioned just beneath the connection point or the coupler section 10 of the strip 3. Island conductor 14 is interconnected to the strip 3 at its connection point 10 via a conductive vertical through hole conductor (hereafter, simply referred to as "through hole" for simplicity) 13 inside box 1. A high frequency or radio frequency (RF) power supply circuit 7 is connected between island 14 and the bottom plate of the box 1 as shown in FIG. 1*b*. Island conductor 14 may thus function as an RF power feed port of the illustrative antenna.

As best depicted in FIG. 1*a*, an island conductor 20 is disposed within the slot 2 at the base of the "U" on the top plate of the box 1. A variable capacitance circuit 16 is mounted on the top wall plate of the frame 1 in a way such that circuit 16 is connected between the island conductor 20 and the top plate of the box 1. The variable capacitance circuit 16 has a control terminal connected via a lead wire 30 to its associated control circuit 50, which is also mounted on the top plate of the box 1. The control circuit 50 is operable to supply a DC voltage of a selected potential to the control terminal of the variable capacitance circuit 16 through the control lead 30.

The variable capacitance circuit 16 is variable in capacitance between its pair of terminals under control of the control circuit 50, one of which terminals is connected to the island conductor 20 and the other of which is to the top plate of the box 1 at a selected location thereon. The control node of the variable capacitance circuit 16 is for receiving a DC voltage control signal used to vary the terminal-to-terminal capacitance. The control lead 30 has one end connected to the control terminal of circuit 16 and the other end coupled to the controller 50. The control signal from controller 50 is variable in potential level thus rendering the value of a capacitance between island 20 and box 1 likewise variable.

The capacitance between the island conductor 20 and flat rectangular box 1 is combinable with the capacitance between strip conductor 3 and island conductor 20 into a synthetic capacitance which may provide an additive or extra capacitance between a certain location at or near the open edge of strip 3 spaced far from the connection point 10 thereof and a box plate coupled to ground, whereby the density of electric flux lines at the location at or near the open end of strip 3 far from the connection point 10 increases, as compared to the case where the island conductor 20 and variable capacitance circuit 16 are absent, so that the density of current as induced on the strip 3 increases accordingly so as to compensate for an increase in electric flux line density. This results in the strip 3 being virtually changed in length, which in turn permits the impedance matching center frequency, namely resonant frequency, to change or vary accordingly. Since the synthetic capacitance is made of series-connected capacitances, it is possible by reducing the capacitance value between the strip 3 and island conductor 20 to attain fine or precise capacitance value variation even where the capacitance between the island conductor 20 and box 1 is greatly changed in value by the variable capacitance circuit 16. This in turn enables the illustrative antenna to vary in resonance frequency with enhanced precision.

In addition, the island conductor 20 residing within the slot 2 is capacitively coupled to the top plate of the box 1; accordingly, part of a current generated near or around the slot 2 behaves to flow into the island conductor 20 depending on the actual capacitance value selected. Therefore, permitting the variable capacitance circuit 16 to vary or modify the capacitance value between the island conductor 20 and box 1 makes it possible for the current generatable around slot 2 to change in flow path—that is, enabling the slot 2 to virtually or equivalently change its physical length.

One of the significant advantages of the slot antenna shown in FIGS. 1*a*–1*b* lies in capability to permit both the strip conductor 3 and slot 2 to equivalently change or vary in length at a time by causing the variable capacitance circuit 16 to appropriately modify or alter the capacitance value between the island conductor 20 and box 1. Since the antenna matching condition employable in the coaxial resonator-based slot antenna is determinable depending on both the current phase on the strip 3 just beneath the slot 2 and the length of slot 2, the use of the illustrative structure capable of simultaneously altering the both parameters makes it possible for the antenna impedance-matching center frequency, i.e. resonant frequency, to widely vary or change over an extended region without having to badly affect the matching condition per se.

Another advantage of the embodiment of FIGS. 1*a*–1*b* is that the modifiability or changeability of the capacitance between the island conductor 20 and box 1 may render the resonant frequency likewise variable under control of the control circuit 50 which is for use in supplying the variable capacitance circuit 16 with a control signal for the intended capacitance variation or adjustment. This in turn allows the control signal from control circuit 50 to vary in conformity with a variable RF frequency as selectively allocated per wireless communication attempt, such as a telephone interconnect call over public telephone network channels, thereby letting the RF frequency be identical to the resonance frequency. It is thus possible to force the antenna's bandwidth at a certain resonance frequency to be limited to the bandwidth required for a presently desired communication event which must be extremely less than the entire frequency band coverage the system requires, thereby enabling the slot antenna to decrease in volume. In addition, the slot antenna with the structure stated supra is wide in variable range of resonance frequency, and is thus applicable to mobile radio, portable radio, or radio/telephone terminals for use in wireless communication systems with increased system frequency band.

The antenna of FIGS. 1*a*–1*b* may be designed to have a thickness-reduced or "thin" planar structure that is as flat as currently available coaxial resonant slot antenna, which leads to the applicability to built-in antenna configurations with no particular outer projections by mounting the illustrative antenna on a mother board of RF circuitry in communication terminals such as for example cellular radiotelephone handsets.

It should be noted that the prescribed "antenna dimension reduction" concept per se—i.e. the antenna dimension is reduced due to fulfillment of a dielectric material inside the flat frame body as compared to the case of no such dielectric materials—may be similar in principle to that disclosed in the above-identified copending U.S. Patent Application based on Japanese Patent Application No. 9-54825.

Second Embodiment

Figure 2A:
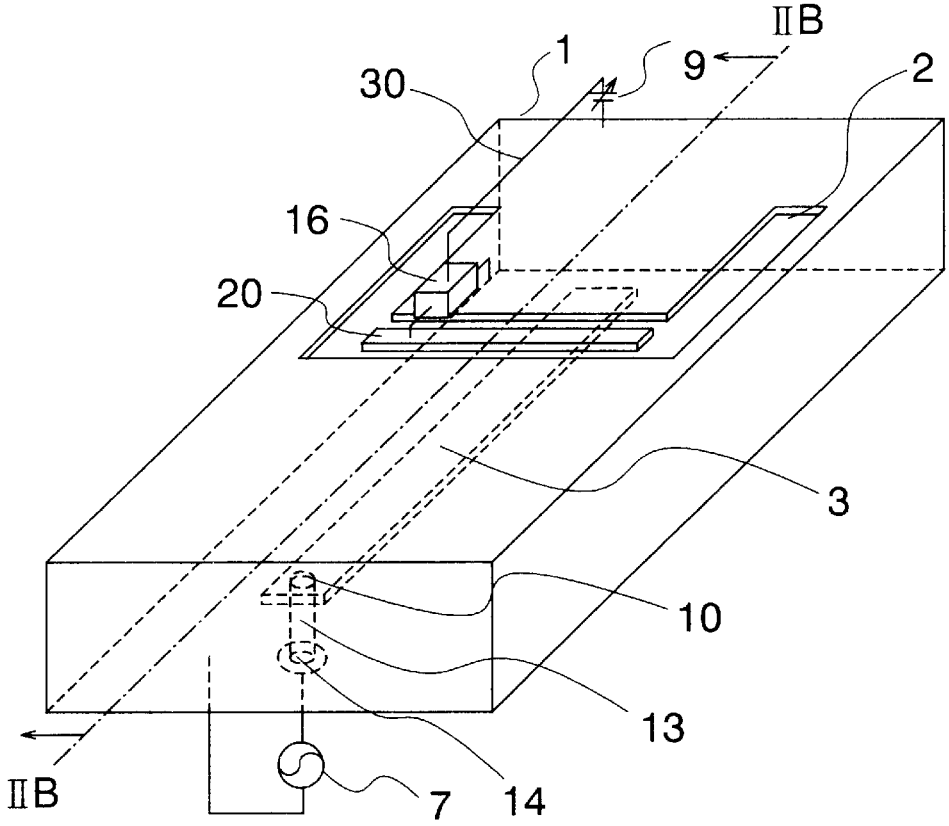
FIG. 2*a* is a perspective view of a tunable slot antenna according to a second embodiment of the present invention.
Figure 2B:
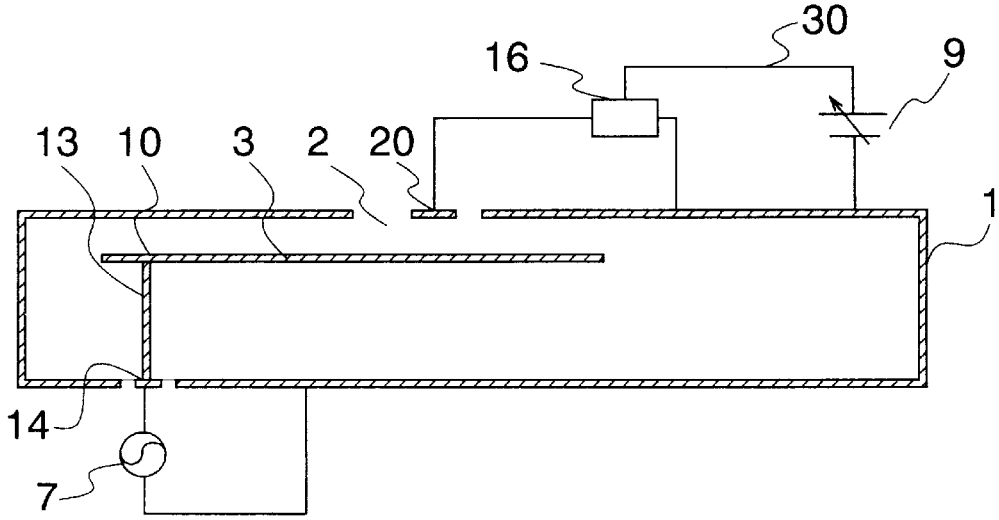
FIG. 2*b* is a section view taken along line IIB—IIB in FIG. 2*a*.

A tunable slot antenna in accordance with another embodiment of the invention is shown in FIGS. 2*a* and 2*b*, which is generally similar to that of FIGS. 1*a*–1*b* with the control circuit 50 being replaced by a variable DC power supply circuit 9. In this configuration the variable capacitance circuit 16 is responsive to receipt of a DC voltage applied from DC power supply 9 via control lead 30 for varying or changing the capacitance value between the island conductor 20 and flat rectangular box 1.

An advantage of this embodiment is that the transmit/receive or "transceive" characteristics may be enhanced because of the fact that control lead 30 provided near or around the antenna structure is kept substantially constant in potential with time (DC in nature) so that unnecessary noises are hardly given to the antenna.

It is noted here that the variable DC power supply circuit 9 is arranged to vary the voltage potential under control of its associative voltage controller circuitry (not shown), which is operable to generate a control signal for use in identifying an appropriate voltage value corresponding to a presently established radio frequency while permitting the DC power supply 9 to produce a predefined DC voltage in response to such control signal. DC power supply 9 has its control signal receive terminal (not shown) for input of the control signal.

Third Embodiment

Figure 3A:
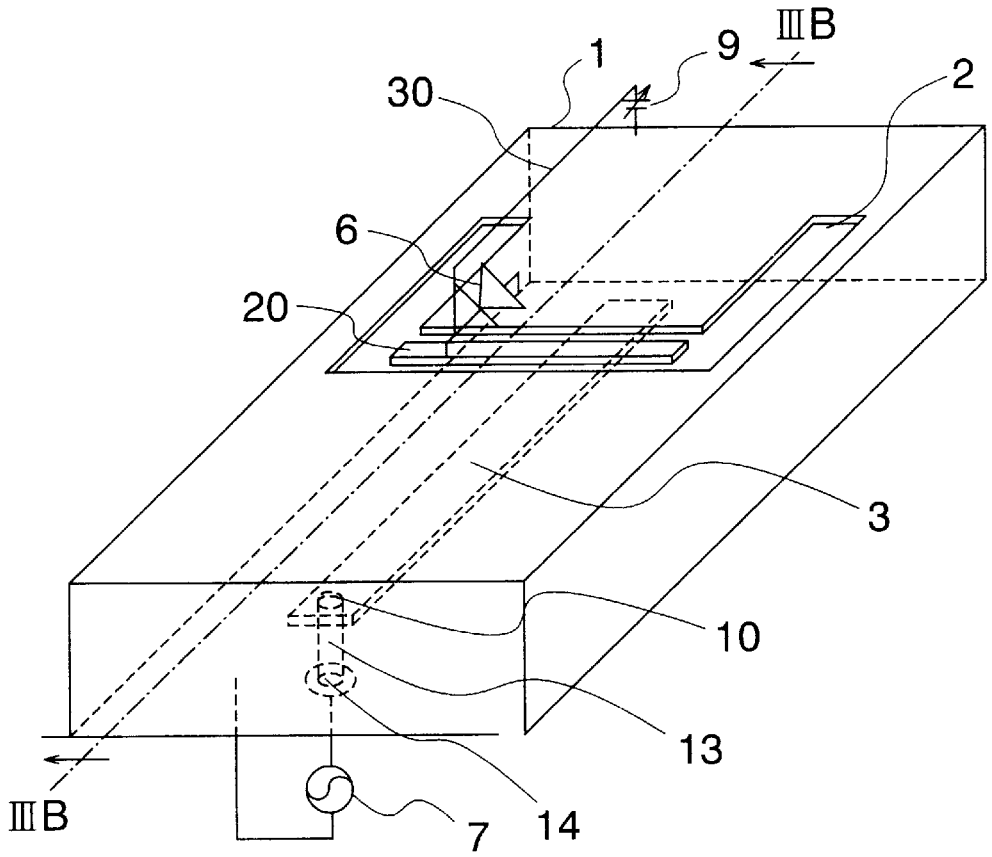
FIGS. 3*a* is a perspective view of a tunable slot antenna according to a third embodiment of the present invention.
Figure 3B:
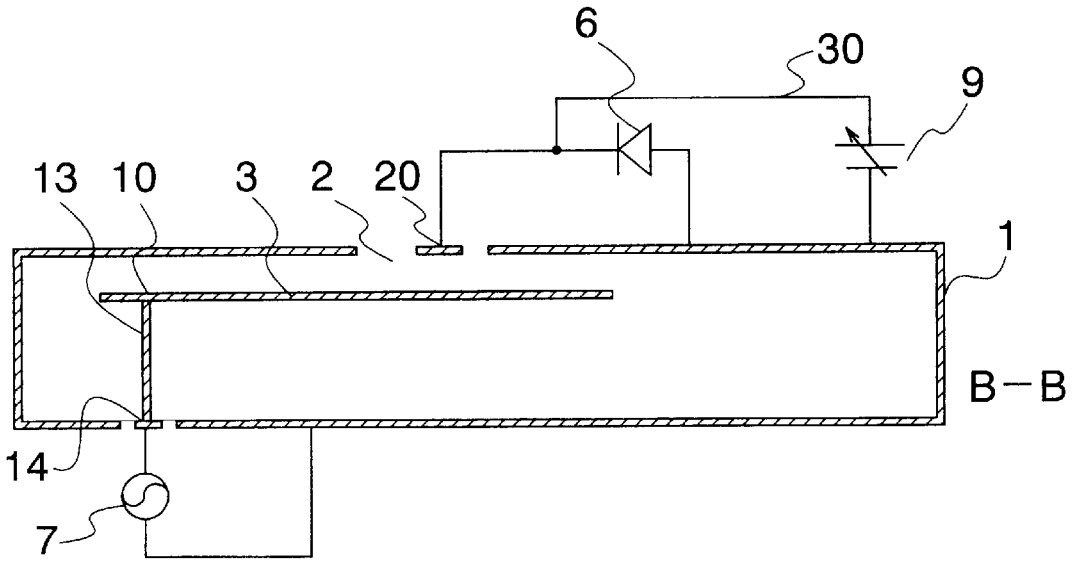
FIG. 3*b* is a sectional view taken along line IIIB—IIIB in FIG. 3*a*.

Referring now to FIGS. 3*a* and 3*b*, a tunable slot antenna in accordance with still another embodiment of the invention is shown which is similar to that of FIGS. 2*a*–2*b* with the variable capacitance circuit 16 being replaced with a specific variable capacitor element 6. This element may continuously vary in capacitance value upon receipt of a DC voltage. Element 6 may typically be a variable capacitance diode, which is called the "vari-cap" diode in some cases.

The diode 6 has its one node connected to the slot island conductor and the other node coupled to the grounded top plate of the flat rectangular box 1. Island conductor 20 and box 1 define a specified capacitance therebetween whose value is variable or changeable by applying a selected DC voltage from variable DC power supply 9 to the island 20 via control lead 30.

An advantage of the slot antenna structure shown in FIGS. 3*a*–3*b* lies in the capability to reduce complexity of circuit configuration thus reducing the cost penalty of parts used. This can be said because the variable capacitance circuit consists essentially of a single variable capacitance diode 6. Another advantage is that the resonant frequency may be continuously adjustable to have any desired values by appropriately determining the value of a DC voltage used. This is true because diode 6 is of the device capable of continuously varying its capacitance value.

It is to be noted that a voltage controller circuit (not shown) operatively associated with such variable capacitance diode 6 is designed to prestore therein the relation of a DC application voltage versus capacitance value of diode 6, and also capable of permitting the antenna's resonant frequency to be identical or "tuned" at any desired radio frequency by "notifying" variable DC power supply 9 of an appropriate voltage value for production of the intended capacitance value corresponding to the radio frequency.

Fourth Embodiment

Figure 4A:
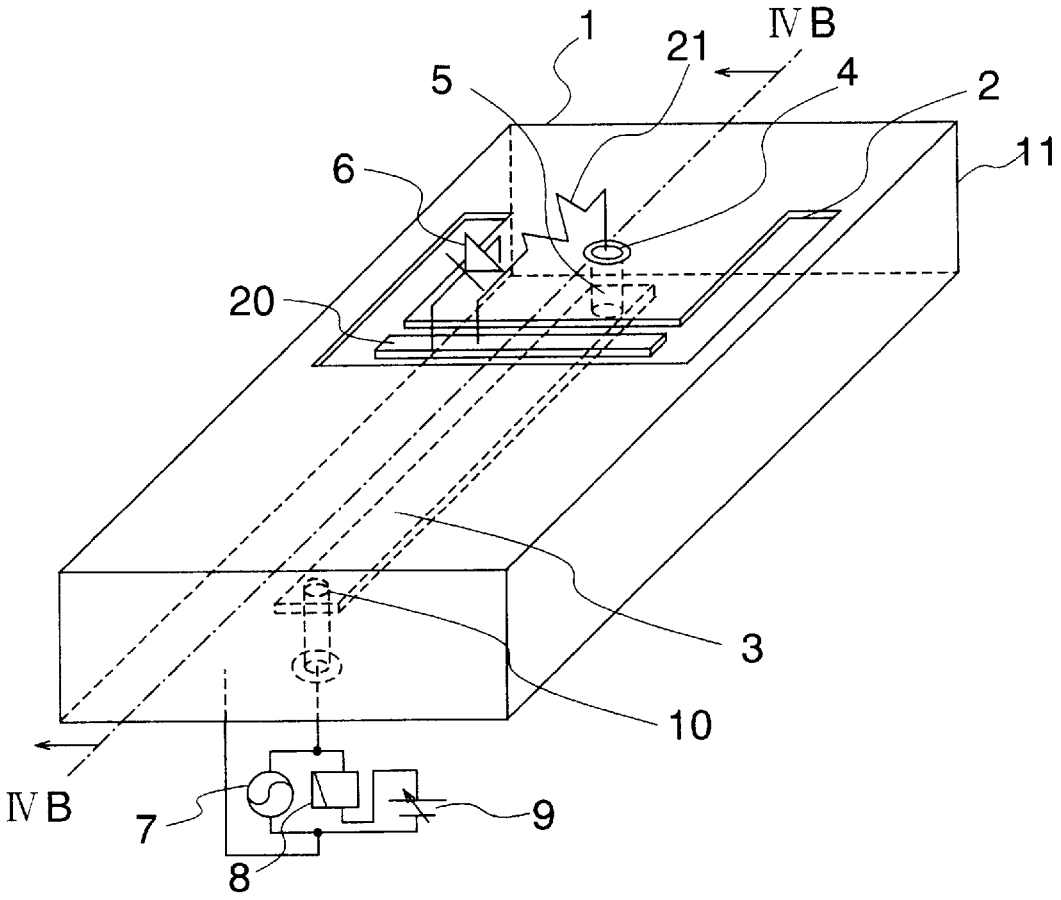
FIG. 4*a* is a perspective view of a tunable slot antenna according to a fourth embodiment of the present invention.
Figure 4B:
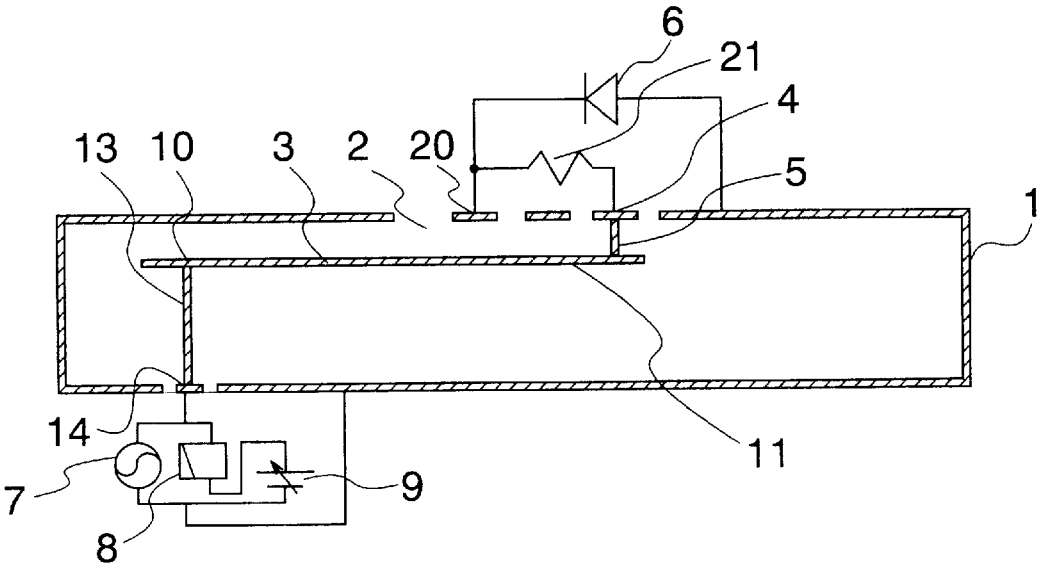
FIG. 4*b* is a sectional view taken along line IVB—IVB in FIG. 4*a*.

Turning now to FIGS. 4*a* and 4*b*, a tunable slot antenna in accordance with yet another embodiment of the invention is shown which is designed so that the DC voltage feed part for supplying a DC voltage to the variable capacitor element is coupled to the connection point of strip conductor 3. More specifically, as best illustrated in FIG. 4*b*, a variable capacitance diode 6 is associated with a resistive element 21. The resistor 21 has one end connected to the island conductor 20 and the other end coupled to an island conductor 4, which is provided in a small opening defined in the top plate of flat rectangular box 1 in a way such that the island conductor 4 is electrically insulated from the top wall plate of the box 1. The round island 4 is in turn connected via a conductive though-hole 5 to strip conductor 3 at a specified location at or near the free or open end of the strip 3 far from the connection point 10.

Resistor 21 has its resistance value large enough to be negligible relative to the RF impedance at the far opposite end of strip 3 distant from the connection point 10 while at the same time being sufficiently less than the impedance of a DC voltage application node of a variable capacitance element 6, thereby enabling island conductor 20 to be substantially equal in DC potential to the connection point 10 without deteriorating the RF power fed to the strip 3. More practically, the prescribed condition is achievable by setting the resistance of the resistor 21 at a value falling within a range of from several kilo-ohms (kΩ) to several hundreds of kΩ.

Coincidence of the DC voltage feed part of the variable capacitance element 6 to the connection point 10 of the strip 3 may avoid the necessity of employing the control lead 30, thus further reducing complexity of circuit configuration. The elimination of control lead 30 disposed near the slot 2 leads to the capability of further suppression of affection to radiation patterns of the antenna.

The connection point 10 is fed with RF current and DC voltage from the island conductor 14, which is insulatively disposed in the small hole in the bottom plate of frame 1 and is electrically connected to the connection point 10 via through hole 13. The power feed scheme using an RF power supply circuit 7 and variable DC power supply 9 as well as a specific device or element 8 used for elimination of RF current drain toward DC power supply 9 may be similar in principle to that taught by he above-identified copending U.S. Application based on Japanese Patent Application No. 9-54825.

Fifth Embodiment

Figure 5A:
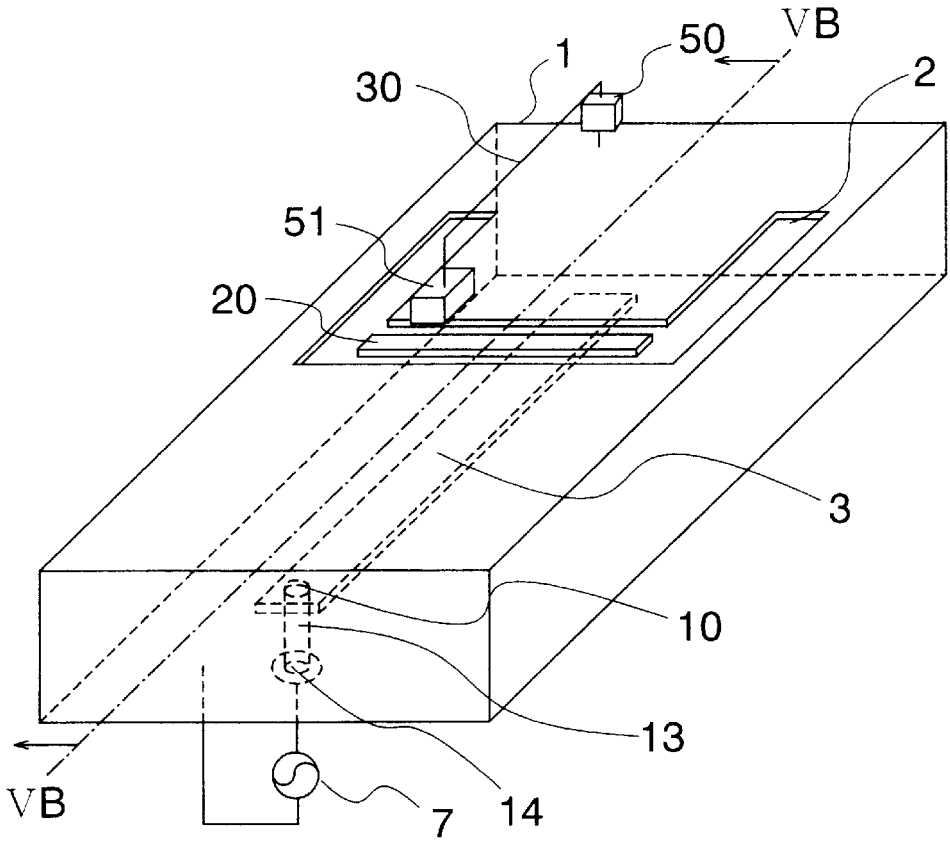
FIG. 5*a* is a perspective view of a tunable slot antenna according to a fifth embodiment of the present invention.
Figure 5B:
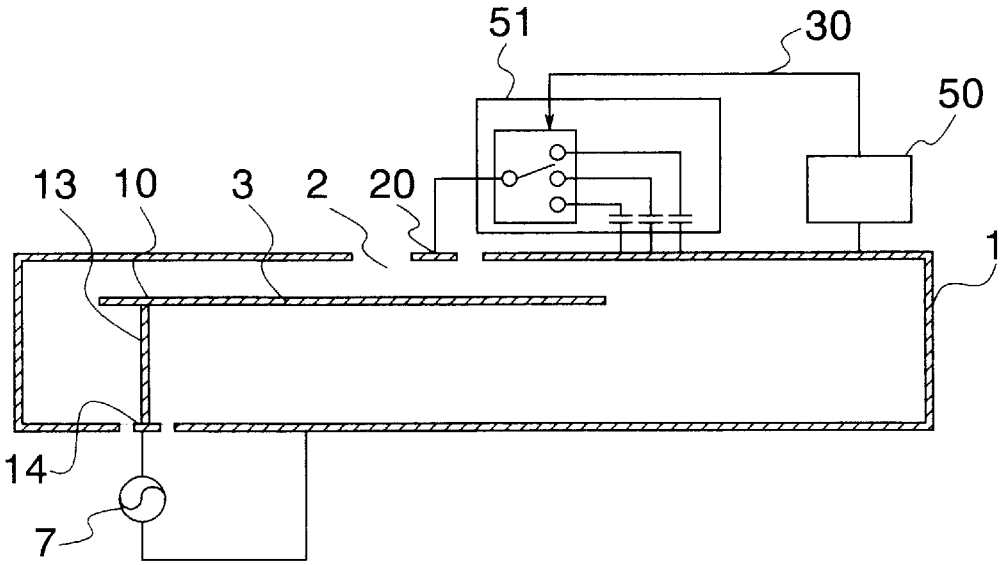
FIG. 5*b* is a sectional view taken along line VB—VB in FIG. 5*a*.

Referring now to FIGS. 5*a*–5*b*, a tunable slot antenna in accordance with a further embodiment of the invention is shown which employs a variable capacitance circuit capable of switching the interterminal capacitance between two or more values in response to a control signal supplied thereto. More specifically, the antenna module shown is similar to that of FIGS. 1*a*–1*b* with the variable capacitance circuit 16 being replaced by a multiple capacitance-value changeable capacitance circuit 51. As best shown in FIG. 5*b*, this circuit 51 consists essentially of a serial combination of a multi-node RF switch device and a preselected number of parallel capacitors coupled thereto. In this embodiment the switch may be a three-node switch operable to selectively change its output capacitance value among three different values of the capacitors. As shown in FIG. 5*b*, multi-variable capacitance circuit 51 has its common switch node connected to the slot island conductor 20 while the three capacitively variable terminals thereof are electrically coupled to the grounded top plate of the box 1, through three parallel capacitors of predefined capacitance values different from one another. Variable capacitance circuit 51 is responsive to a control signal supplied from control circuit 50 via control lead 30 to a control terminal of circuit 51, for performing a switching operation to let the capacitance between the island conductor 20 and box 1 be set at a desired value as selected from among the three preset capacitance values.

Preferably, respective capacitors of capacitance circuit 51 are designed so that the antenna resonant frequency determinable depending on the capacitance value between the island conductor 20 and box 1 is exactly the same as any one of desired antenna resonance frequencies. It is thus possible, by supplying circuit 51 with a control signal permitting generation of respective capacitance values, to cause the antenna resonance frequency to be identical or "tuned" at any desired frequency. In this case the slot antenna of FIGS. 5*a*–5*b* might come with a limitation as to the attainability of limited resonant frequency values as compared to the second embodiment shown in FIGS. 2*a*–2*b* with continuous capacitance-value changeability due to DC voltage application; fortunately, the presence of such limitation will never raise any serious problems when reduction to practice for application to mobile radiotelephone handsets because of the fact that the carrier frequency for use therein must set at a series of discrete values.

Additionally, the control signal being supplied to the variable capacitance circuit 51 of FIG. 5*b* may be a digital signal that exhibits differences in potential level and/or variable pattern with time for use in enabling execution of the intended capacitance-value switching. Such digital signal is inherently durable against the signal interference as applied from other circuits used, which may in turn enable achievement of enhanced resonant frequency stability—that is, permitting the antenna to be stably set at its required fixed resonance frequency in an extended time.

Sixth Embodiment

Figure 6A:
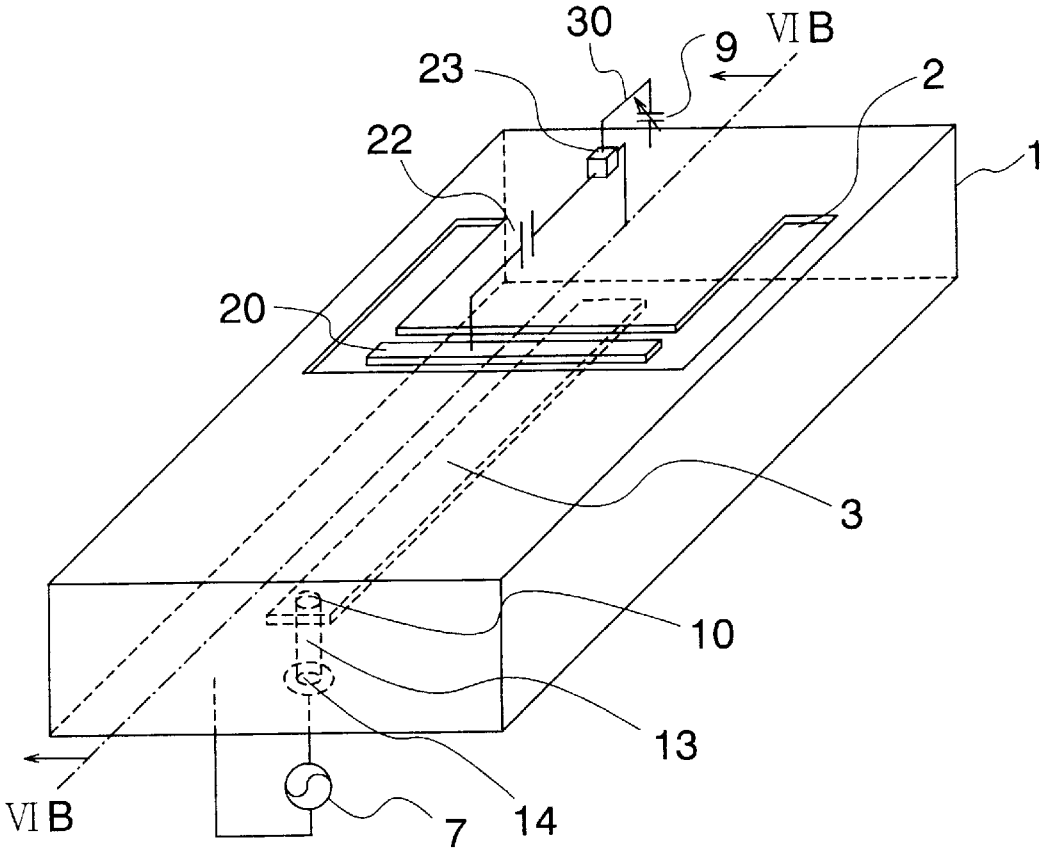
FIG. 6*a* is a perspective view of a tunable slot antenna according to a sixth embodiment of the present invention.
Figure 6B:
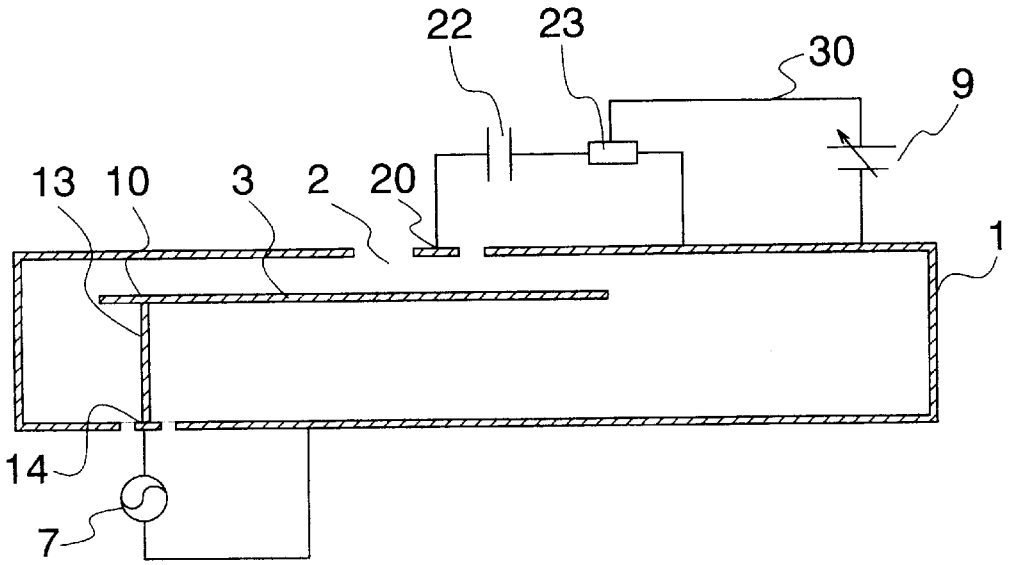
FIG. 6*b* is a sectional view taken along line VIB—VIB in FIG. 6*a*.

A tunable slot antenna in accordance with a still further embodiment of the invention is shown in FIGS. 6*a*–6*b*, which is similar to that shown in FIGS. 5*a*–5*b* with the control circuit 50 being replaced by the variable DC power supply circuit 9 of FIG. 2*b* and with the variable capacitance circuit 51 of FIG. 5*b* being replaced by a combination of a capacitor 22 and a high frequency or RF switch 23. The series connection of capacitor 22 and RF switch 23 functions as the variable capacitance circuit capable of switching its output capacitance between two or more preset interterminal capacitance values, the latter being such that the impedance between certain terminals is changeable in response to receipt of a DC voltage at a selected terminal. Capacitor 22 has two nodes one of which is connected to island conductor 20 and the other of which is to one of input and output terminals of the RF switch 23, which has its other terminal coupled to the top plate of rectangular box 1. The RF switch 23 also has a control terminal tied to control lead wire 30. Upon application of a DC voltage from variable DC power supply 9 via the control lead 30, the RF switch 23 may change its impedance between the input and output terminals so that the resulting impedance is changeable between the high and low states depending on the potential value of the DC voltage applied.

With such an arrangement, the resultant value of a capacitance between the island conductor 20 and the flat box 1 is equal to the value of an conductor-to-conductor capacitance as inherently present between the island conductor 20 and frame 1 in cases where the RF switch 23 is in the high impedance state between the input and output terminals thereof; alternatively, where the input/output impedance is low, the resulting capacitance value equals the interconductor capacitance value plus a capacitance value of the capacitor 22.

The variable DC power supply circuit 9 is variable in potential under control of its associated voltage controller circuit (not shown). This voltage controller is designed to generate a control signal for determination of an appropriate voltage value corresponding to a presently selected RF frequency, whist variable DC power supply 9 is responsive to receipt of the control signal for producing a predefined DC voltage. Variable DC power supply 9 may have its control signal input terminal (not shown) for receiving the control signal.

An advantage of the tunable slot antenna of FIGS. 6*a*–6*b* is that two different resonant frequencies may selectively be established in a switchable fashion in response to the DC voltage as applied from variable DC power supply 9 under control of the voltage controller.

While this embodiment is designed to make use of a serial combination of single RF switch 23 and one capacitor 22, a parallel combination of a plurality of such similar switch/capacitor serial connections may alternatively be employable between the island conductor 20 and the top plate of the box 1, thereby enabling achievement of multiple capacitance values and thus plural resonant frequency values on a case-by-case basis. Still alternatively, such multiple serial switch/capacitor combinations may be replaced with circuitry including plural capacitors and an RF switch with multiple input/output nodes which are implemented together into a single IC chip package. With such an arrangement also, similar advantages are obtainable.

Seventh Embodiment

Figure 7A:
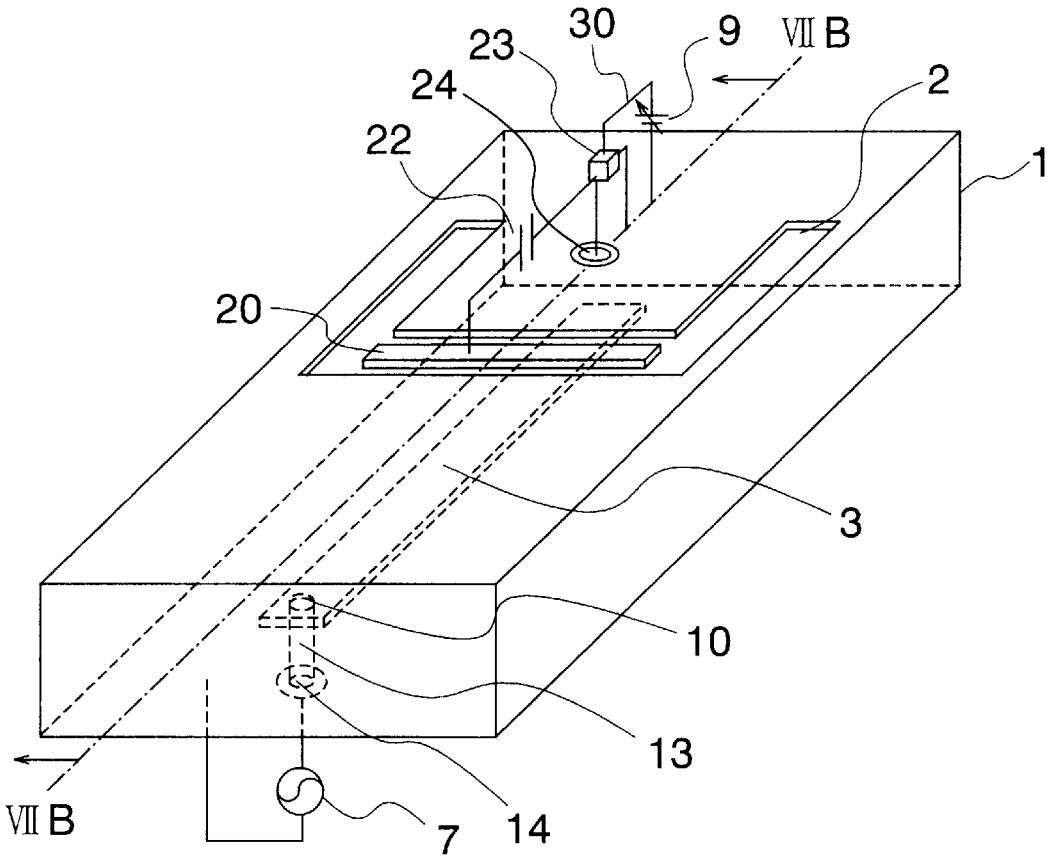
FIG. 7*a* is a perspective view of a tunable slot antenna according to a seventh embodiment of the present invention.
Figure 7B:
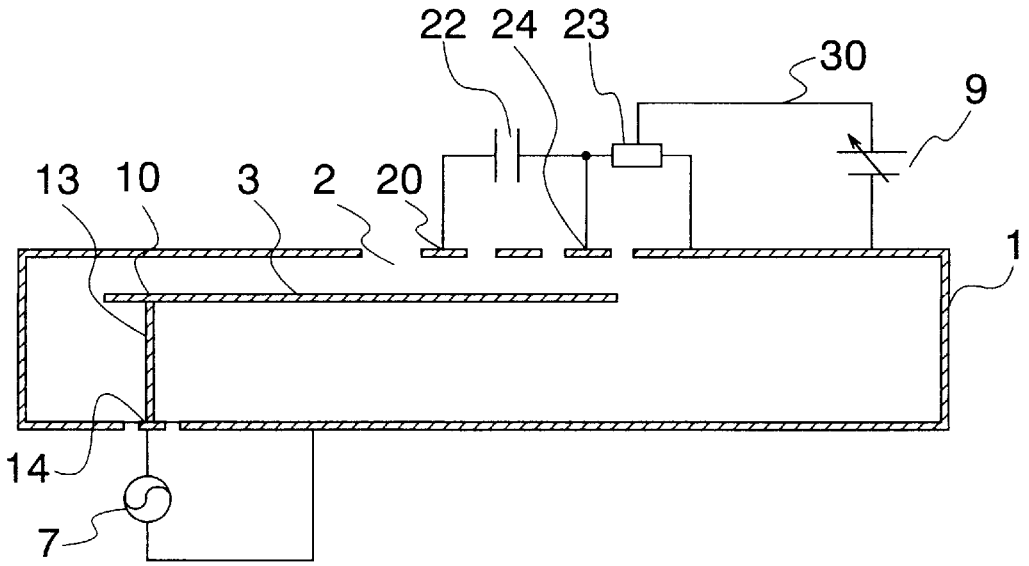
FIG. 7*b* is a sectional view taken along line VIIB-VIB in FIG. 7*a*.

A tunable slot antenna shown in FIGS. 7*a*–7*b* in accordance with a yet further embodiment of the invention is similar to that of FIGS. 6*a*–6*b* with an extra island conductor 24 being added to the top plate of the box 1 and also with a common node between the capacitor 22 and RF switch 23 being electrically connected to island 24. More specifically, the island conductor 24 is provided within a small hole formed in the frame top plate in a way such that island conductor 24 is electrically isolated from the box 1. The switch/capacitor common node is conducted by a lead wire to round island 24 as depicted in FIG. 7*b*. As shown, the capacitor 22 has one end connected to the elongate island conductor 20 and the other end coupled to island conductor 24. The RF switch 23 has one of its input/output terminals coupled to the island conductor 20 and the opposite end conducted to the grounded top plate of the box 1.

With such an arrangement, it becomes possible to potentially fix or settle the capacitor 22 and the input/output terminals of RF switch 23 to respective conductors on the top of the box 1, thus increasing the reliability of circuitry concerned. Another advantage of this embodiment is that reflow techniques or equivalents thereto for use in mounting electronics parts on standard printed circuit boards (PCBs) may be employed to integrally mount respective necessary parts or components on the slot antenna frame body 1, thereby greatly reducing assembly costs in the manufacture of the antenna module.

Eighth Embodiment

Figure 8A:
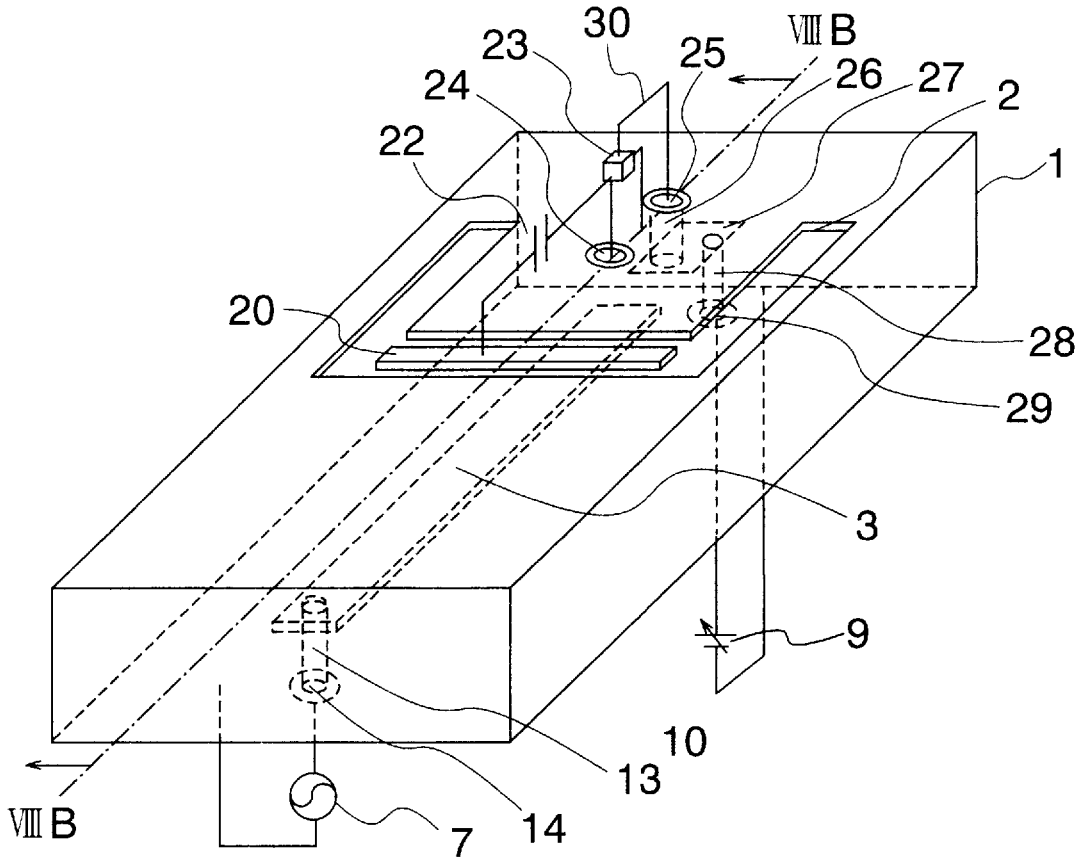
FIG. 8*a* is a perspective view of a tunable slot antenna according to an eighth embodiment of the present invention.
Figure 8B:
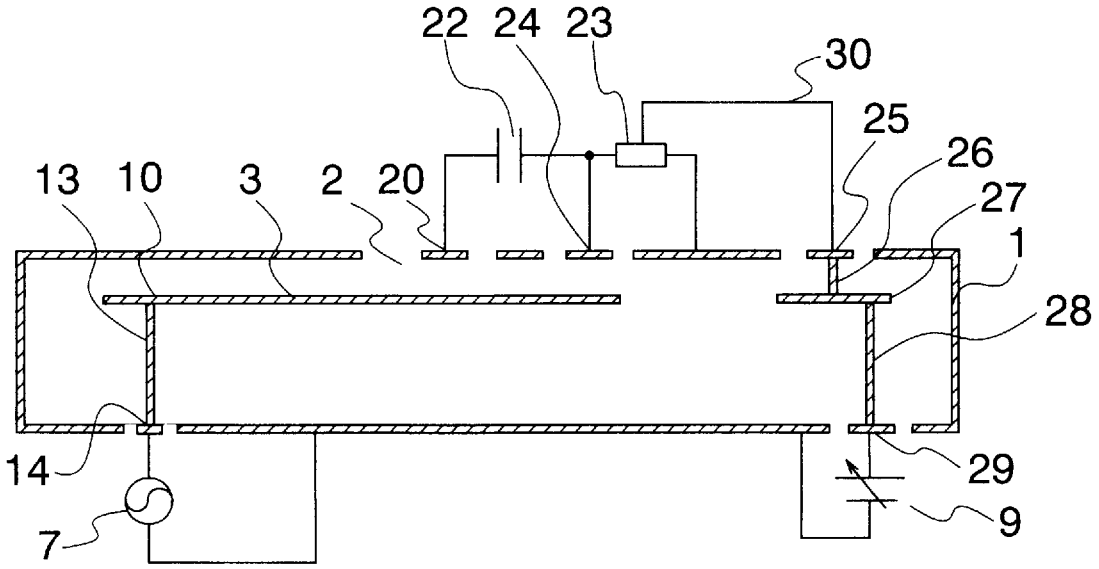
FIG. 8*b* is a sectional view taken along line VIIIB—VIIIB in FIG. 8*a*.

A tunable slot antenna shown in FIGS. 8*a*–8*b* is similar to that of FIGS. 7*a*–7*b* with the control lead wire being partly placed in the interior of the flat box 1. More specifically, the box 1 has further island conductors 25 and 29 on its top and bottom plates, respectively. Upper island conductor 25 is provided within a small hole formed in the top plate of the box 1 so as to be electrically insulated from the box 1. Similarly, lower island conductor 29 is in a small hole in the bottom plate of the box 1 and insulated therefrom. The box 1 includes vertical conductive through holes 26 and 28 which are electrically connected to island conductors 25, 29, respectively. A control lead 27 is formed or "embedded" inside the box 1 to horizontally extend for interconnection between through holes 26, 28 as best shown in FIG. 8*b*. Another control lead 30 has its one end electrically connected to the control terminal of RF switch 23. The other end of the switch 23 is coupled to the island conductor 25, which is insulatively disposed within the hole in the top plate of the box at a selected location near switch 23. The island conductor 25 is tied to the internal control lead 27 via through hole 26 in the box 1. Control lead 27 is in turn coupled via through hole 28 to an island conductor 29 on the bottom plate of the box 1. The island conductor 29 is connected to the variable DC power supply 9 for receiving a DC voltage therefrom to thereby control an operation of the RF switch 23.

An advantage of the structure of FIGS. 8*a*–8*b* lies in the capability to greatly suppress influence upon the antenna's radiation patterns, which influence can otherwise occur due to the presence of "external" control leads outside the box 1. Such suppression is attainable because certain affectable part of the control lead configuration used for application of DC voltage to the variable capacitance circuit is moved or "interplanted" to inside of box 1 so that radiation-pattern affectability decreases accordingly.

Ninth Embodiment

Figure 9A:
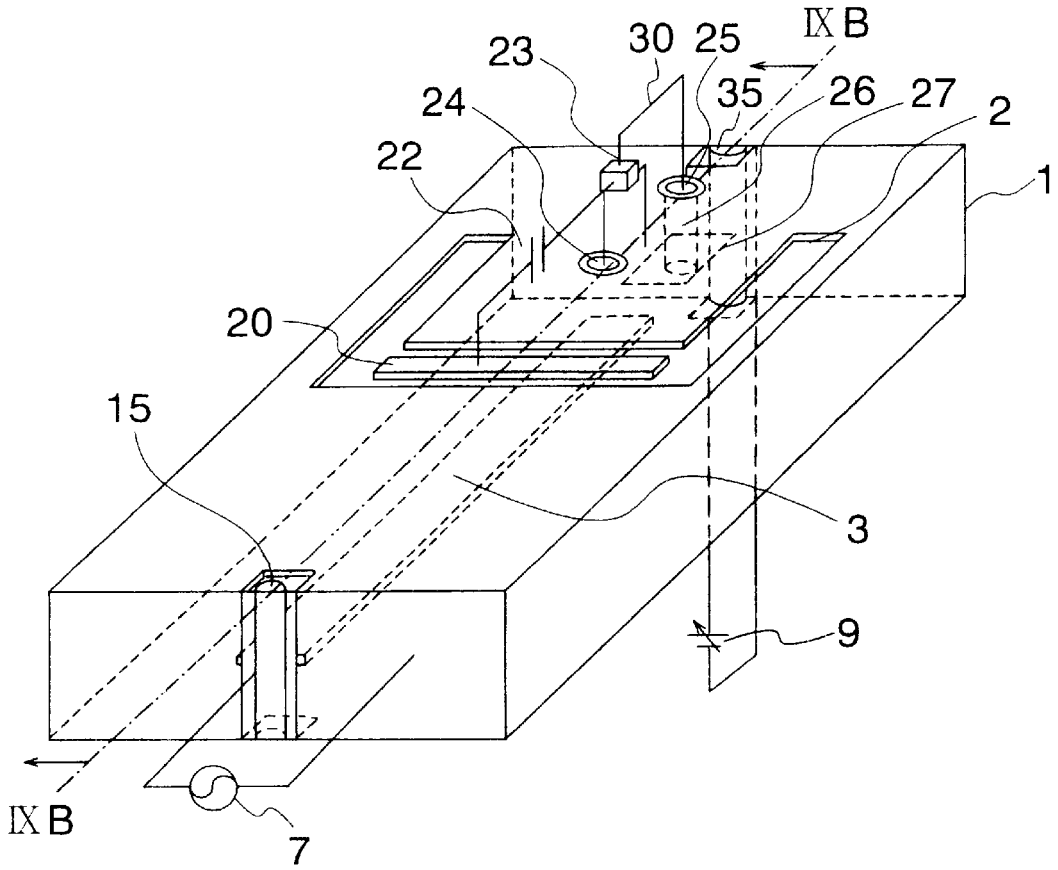
FIG. 9*a* is a perspective view of a tunable slot antenna according to a ninth embodiment of the present invention.
Figure 9B:
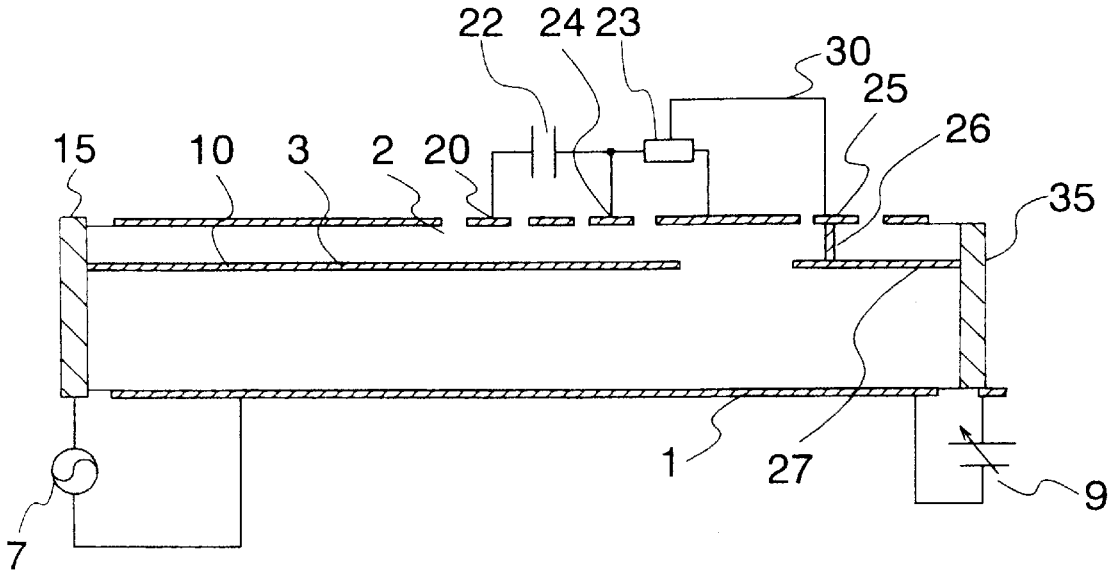
FIG. 9*b* is a sectional view taken along line IXB—IXB in FIG. 9*a*.
Figure 10A:
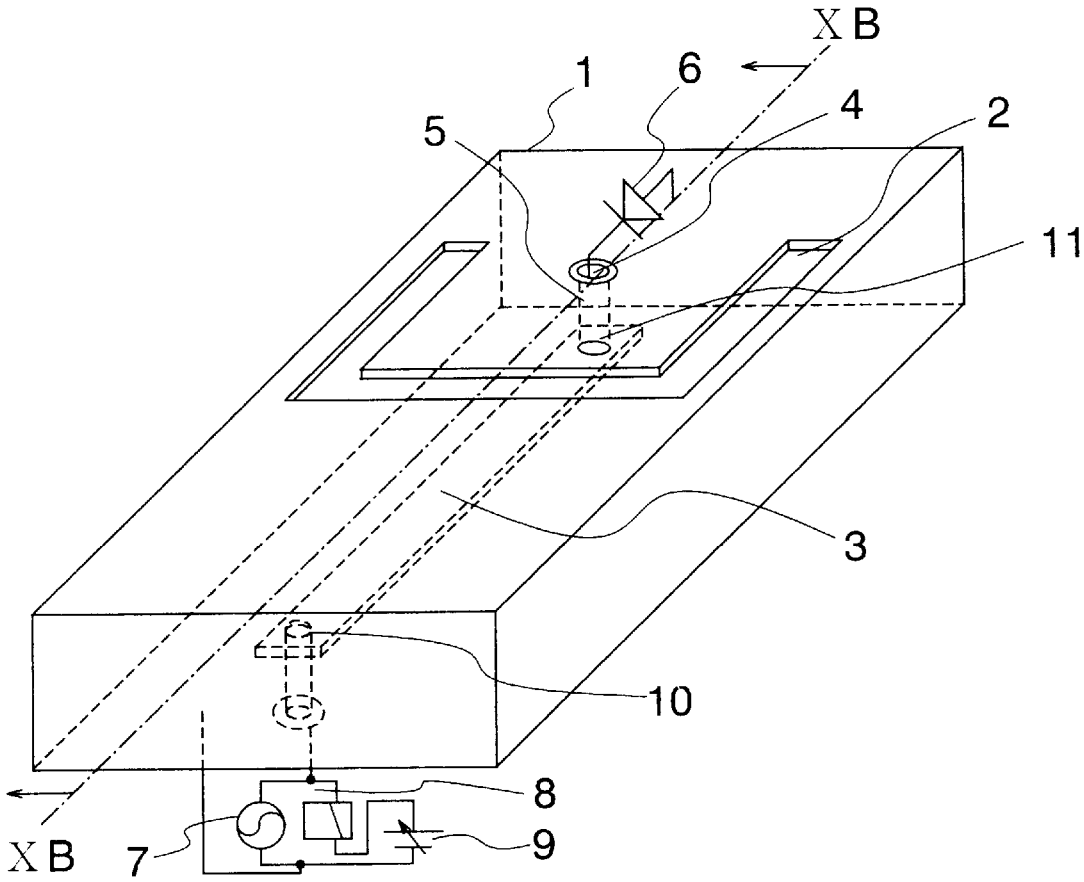
FIG. 10*a* is a perspective view of a tunable slot antenna disclosed in a copending U.S. Application based on Japanese Patent Application No. 9-54825.
Figure 10B:
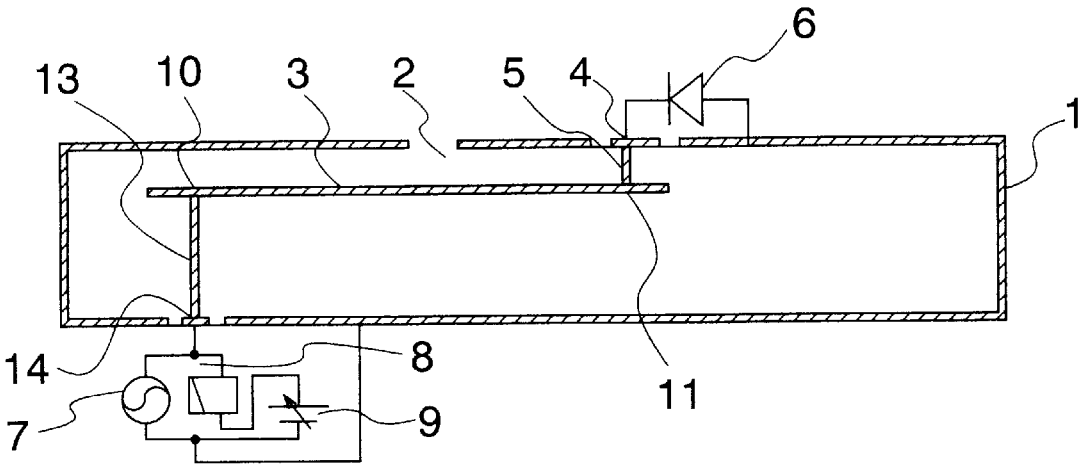
FIG. 10*b* is a section view taken along line XB—XB in FIG. 10*a*.

A tunable slot antenna shown in FIGS. 9*a*–9*b* is similar to that shown in FIGS. 8*a*–8*b* with the strip conductor 3 and the internal control lead 27 inside the flat box 1 being modified in electrical connection with respect to their associated external parts or components of the antenna. More specifically, strip 3 is connected to its associated RF power supply circuit 7 via an end-face through hole 15 with a semicircular cylindrical profile. Through hole 15 extends vertically along one of the end wall plates of rectangular the box 1 of FIG. 9*a*, and is electrically insulated from the box 1. In other words, the connection point 10 of strip 3 is coupled to through hole 15 on the end wall plate of the antenna. Internal control lead 27 is connected at its one end to the control terminal of "external" RF switch 23 via island conductor 25 and through hole 26 in a way similar to that shown in FIG. 8*b*. Lead 27 is connected at its opposite end to variable DC power supply circuit 9 via the opposite semicircular cylindrical through hole 35 that is vertically elongated along the other end wall plate of the box 1 as shown in FIG. 9*a*. The through holes 13 and 35 may be circular cylindrical as in the other embodiments or may have any other shape.

In this embodiment of FIGS. 9*a*–9*b*, the through hole 15 functions as a coupler-section extension (or leading) terminal whereas the through hole 35 acts as a control-lead power feed node while permitting the lower parts of the through holes 15, 35 to be substantially the same in level as the bottom surface of the box 1—namely, flush with the ground potential plate thereof. This may facilitate mounting of the slot antenna onto a printed circuit board (PCB) used. One preferable antenna mount procedure is as follows: prepare a PCB with a conductive lead pattern and a ground conductor plane being formed on one surface; then, mount antenna structure of FIGS. 9*a*–9*b* with its bottom surface contacting the PCB. When this is done, the bottom surface of the antenna structure is contacted to the ground conductor plane while simultaneously causing the lead pattern to come into direct contact with the end-face through holes 15, 35. This may allow utilization of currently available standard automated assembly techniques without the need for any additional modifications thereto. The antenna module of this embodiment is advantageous in reducing production costs of cellular radiotelephone handsets when reduction to practice.

Any one of the foregoing tunable slot antenna structures incorporating the principles of the invention may be manufactured using presently available standard multilayer substrate/PCB fabrication technologies, as in the tunable slot antenna as disclosed in the above-identified copending U.S. Patent Application based on Japanese Patent Application No. 9-54825. This may ensure that forming or mounting the antenna and RF circuitry on the same substrate or PCB makes it possible to further reduce parts costs and manufacturing costs of handheld communication terminals including, but not limited to, cellular radiotelephone handsets.

It has been described that the tunable slot antenna modules embodying the present invention stated supra are capable of varying or altering the antenna's impedance matching center frequency, i.e. resonant frequency, in a wide bandwidth without having to adversely affecting the inherent matching condition of the antenna. This may be achievable due to one unique feature that enables both the slot and the strip conductor immediately underlying the same to equivalently vary in length simultaneously. The enhanced resonant frequency variability makes it possible for the antenna modules disclosed herein to be preferably applicable to mobile radiotelephone handsets with a wide system frequency range. Applying the antenna to such handheld communication units enables the antenna's resonant frequency to accurately keep track of radio frequencies selectively updated every time a telephone interconnection is established, which in turn makes it possible to reduce the frequency band the antenna must cover, thus reducing the volume of antenna. When applying the antenna modules, resultant cellular radiotelephone handsets are capable of elimination of external projections thereby increasing portability and hand-carriability while reducing the size thereof.

While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

It is claimed:

1. A slot antenna having a conductive box, a slot in a principal surface of the box, and a conductor disposed in said box to spatially cross said slot while being electrically insulated from said box thereby permitting alternate current (AC) power to be supplied between said conductor and said box, the slot antenna comprising:

an island conductor provided in said slot and electrically insulated from said box; and circuitry connected between said island conductor and a wall plate of said box for varying a capacitance between said island conductor and said box;

wherein said circuitry includes a first terminal, a second terminal, and a variable capacitance element responsive to a direct current (DC) voltage at said first terminal for varying a capacitance value between said first and second terminals.

2. A slot antenna according to claim 1, further comprising a variable DC power supply connected to said first terminal.

3. A slot antenna having a conductive box, a slot in a principal surface of the box, and a conductor disposed in said box to spatially cross said slot while being electrically insulated from said box thereby permitting alternate current (AC) power to be supplied between said conductor and said box, the slot antenna comprising:

an island conductor provided in said slot and electrically insulated from said box;

circuitry connected between said island conductor and a wall plate of said box for varying a capacitance between said island conductor and said box; and a control circuit for supplying a control signal to said circuitry; and said circuitry having a first terminal connected to said island conductor, a second terminal connected to a wall plate of said box, and a third terminal connected to said control circuit, said circuitry being responsive to the control signal supplied from said control circuit to said third terminal for rendering variable a value of a capacitance between said island conductor connected to said first terminal and the wall plate of said box connected to said second terminal.

4. A slot antenna according to claim 3, wherein said circuitry has a variable capacitance element changeable in value upon application of a DC voltage, said variable capacitance element being connected between said first terminal and said second terminal.

5. A slot antenna according to claim 4, wherein said variable capacitance element includes a capacitance variable diode.

6. A slot antenna according to claim 3, wherein said control circuit includes a variable DC power supply circuit.

7. A slot antenna according to claim 3, wherein said circuitry has a plurality of capacitive elements of different capacitance values, and a switch responsive to the control signal supplied to said third terminal for switching a connection between one of said capacitive elements and one of the first and second terminals.

8. A slot antenna according to claim 3, further comprising a control lead for connecting said third terminal of said circuitry with said control circuit via a first through-hole conductor formed in a top plate of said box and a second through-hole conductor formed in a bottom plate of said box, wherein said circuitry is disposed over said top plate of said box and said control circuit is disposed under said bottom plate of said box.

9. A slot antenna according to claim 3, wherein said box has a side wall plate with a through hole being insulatively provided therein for causing said control circuit and said third terminal to be connected together via said through-hole.

10. A slot antenna according to claim 3, wherein said box has a side wall plate with a through-hole being insulatively provided therein for allowing AC power feed between said conductor and said box via said through-hole.

11. A slot antenna having a conductive box, a slot in a principal surface of the box, and a conductor disposed in said box to spatially cross said slot while being electrically insulated from said box thereby permitting alternate current (AC) power to be supplied between said conductor and said box, the slot antenna comprising:

an island conductor provided in said slot and electrically insulated from said box; and circuitry connected between said island conductor and a wall plate of said box for varying a capacitance between said island conductor and said box;

wherein said circuitry has a capacitive element and an impedance-varying device responsive to a DC voltage for rendering an impedance variable.

12. A slot antenna according to claim 11, wherein said box has a principal surface with an island conductor being insulatively provided thereon outside said slot, said capacitive element and said impedance-varying device having a common connection node being in turn connected to said island conductor provided outside said slot.

13. A slot antenna having a conductive box, a slot in a principal surface of the box, and a conductor disposed in said box to spatially cross said slot while being electrically insulated from said box thereby permitting alternate current (AC) power to be supplied between said conductor and said box, the slot antenna comprising:

an island conductor provided in said slot and electrically insulated from said box; and circuitry connected between said island conductor and a wall plate of said box for varying a capacitance between said island conductor and said box;

wherein said circuitry has a plurality of series connections of capacitive elements and impedance-varying device, each said device rendering variable the impedance in response to a DC voltage applied thereto, said capacitive elements being different in capacitance value from each other.

14. A slot antenna having a conductive box, a slot formed in a principal surface of the box, a conductor disposed spatially intersecting said slot in said box and electrically insulated from said box, and a coupling section connected to said conductor, said coupler section and said box receiving AC power as fed therebetween, said antenna comprising:

an island conductor provided in said slot and electrically insulated from said box;

a variable capacitance element connected between said island conductor and said box;

a resistive element connected between said island conductor and said conductor intersecting said slot; and a variable DC power supply circuit connected to said coupling section for generating and applying a DC voltage to said variable capacitance element via said coupling section and said resistive element.

15. A slot antenna according to claim 14, further comprising a device connected between said coupling section and said variable DC power supply circuit for elimination of AC voltage dispersion.

* * * * *